United States Patent [19]

Dickey et al.

[11] Patent Number: 4,464,847

[45] Date of Patent: Aug. 14, 1984

[54] MACHINE FOR DEWATERING AGGREGATE SOLID SUBSTRATES BY MISCIBLE LIQUID DISPLACEMENT

[75] Inventors: Leland C. Dickey; Maya Tayter, both of Omaha, Nebr.

[73] Assignee: InterNorth, Inc., Omaha, Nebr.

[21] Appl. No.: 483,925

[22] Filed: Apr. 11, 1983

[51] Int. Cl.[3] ..... F26B 19/00

[52] U.S. Cl. ..... 34/71; 34/69

[58] Field of Search ..... 34/9, 71, 95, 17, 69, 34/92

[56] References Cited

U.S. PATENT DOCUMENTS

| | | | |
|---|---|---|---|
| 3,374,550 | 3/1968 | Belleau | 34/9 |
| 3,962,798 | 6/1976 | Jackson | 34/9 |
| 3,973,329 | 8/1976 | Feess | 34/9 |
| 4,112,586 | 9/1978 | Lehtinen | 34/9 |
| 4,339,882 | 7/1982 | Dickey et al. | 34/9 |
| 4,397,100 | 8/1983 | Dickey et al. | 34/9 |

*Primary Examiner*—John J. Camby

*Attorney, Agent, or Firm*—Donald F. Haas

[57] ABSTRACT

An apparatus for dewatering aggregate solid substrates is disclosed which is comprised of a frame, two moving permeable belts, means mounted on the frame for guiding the movement of the belts, roller means mounted on the frame for positioning the belts such that the substrate is guided and compressed between them, means for contacting the substrate with a displacement fluid while it is compressed between the belts such that the fluid collects between the top belt and the roller means before permeating through the top belt and contacting the substrate, means for removing relatively pure water which is expressed by the fluid through the bottom belt, means for further compressing the substrate to remove excess displacement fluid, and means for removing the dewatered substrate from the apparatus.

4 Claims, 2 Drawing Figures

MACHINE FOR DEWATERING AGGREGATE SOLID SUBSTRATES BY MISCIBLE LIQUID DISPLACEMENT

BACKGROUND OF THE INVENTION

This invention relates to a machine for separating water from, or dewatering, aggregate soild substrates which contain significant amounts of water. The method has specific relevance to fossilized biomass materials such as peat and coal but also is applicable to other biomass substrates such as agricultural and forestry residues (bagasse, corn stover, sawdust, etc.), crops deliberately grown for their fuel or chemical valve, and sewage sludge. The present invention provides an energy efficient method for removing water from these materials prior to their ultimate use or interim conversion. Since the production of energy or fuel is generally the ultimate use for these substrates, an energy efficient dewatering process could be mandatory for those containing a relatively great amount of water.

It is quite likely that the invention concept will be applied to solid/liquid separations than those described above since nothing in the concept of plug flow contacting restricts its use to water or aqueous fluids. Because of the relatively great amount of energy required to evaporate water, compared for example, to hydrocarbons, dewatering processes benefit most by use of the invention rather than evaporative or other conventional separation methods.

Water laden materials can often be dewatered by compression, the applicability of which is dependent upon the solid structure of the material. The predominant effect of compressive loading on water laden substrates of the type considered here is compaction of the solid structure which reduces the void volume available to the water. Material with a rigid structure, such as a particulate mixture with a wide size distribution, is usually difficult to compress. Peat, for example, can be economically dewatered down only to about 75% moisture content by mechanical squeezing.

A commonly used method of dewatering material such as filter cakes is air displacement. This method is most applicable to materials with an open and uniform pore structure. Where there is a wide particle and hence pore size range, it is very difficult to displace water from the finer void spaces using air because of the tendency for bypassing through the larger channels.

Nonaqueous liquid displacement of water from a porous material has been used commercially only rarely and then with materials that have high value compared to the biomass and similar type substrates considered here. The main drawback to solvent dewatering is the high cost of solvent recovery and/or loss relative to the product. Our copending patent application, *Organic Solid Substrate Dewatering Process Utilizing Primary and Secondary Solvents,* Ser. No. 280,264, filed July 2, 1981, now U.S. Pat. No. 4,339,882, typifies interest in liquid dewatering brought about by the high energy cost of conventional dewatering methods.

Liquid extraction, which is the commonly used and well understood separation process most similar to dewatering by solvent displacement, occurs by bringing about contact between differing liquid phases (one possibly intermixed or associated with a solid) so that a redistribution of the components in the original phases will occur. Design of contacting devices for liquid extraction is based on the definition that an equilibrium distribution, the ultimate product of perfectly intimate contacting, will be achieved from a single perfect contacting stage, (see for example, Treybal, *Mass Transfer Operations,* Ch. 10—Liquid Extraction). It is well known, however, that for packed columns, such as are commonly used in chromatographic equipment, much better separation can be achieved than would be expected if one assumed the column to be a single equilibrium stage. This is explained in chromatographic theory by showing that the moving zone of contact does not reach equilibrium in the sense generally used in chemical engineering unit operations. This invention demonstrates that a similar phenomena can be used in a liquid displacement dewatering process, especially when used in combination with an energy efficient liquid separation method.

In our copending patent application, *Organic Solid Substrate Dewatering Process Based on Plug Flow Contact by an Extractive Fluid,* Ser. No. 327,610, filed Dec. 4, 1981, now U.S. Pat. No. 4,397,100 we disclosed the advantages which are achieved in the dewatering of organic solid substrates by contact with an extractive fluid when the organic solid substrate phase and the extractive fluid phase are both kept in plug flow during contact therebetween. It was disclosed there that a displacement of the water originally present in the substrate can be achieved such that a substantial fraction of the displaced water will be of relatively high purity, thereby reducing the quantity of the extractive fluid which is necessary, which, of course, reduces equipment costs and extractive fluid/water separation costs. The present invention relates to an improved apparatus which utilizes the plug flow concept disclosed in the above-mentioned patent application.

SUMMARY OF THE INVENTION

The present invention relates to an apparatus for dewatering aggregate solid substrates. The apparatus is comprised of a frame, two movable permeable belts, means mounted on the frame for guiding the movement of the belts, roller means mounted on the frame for positioning the belts such that the substrate is guided and compressed between them, means for contacting the substrate with a displacement fluid while it is compressed between the belts such that the fluid collects between the top belt and the roller means before permeating through the top belt and contacting the substrate, means for removing relatively pure water which is expressed by the fluid through the bottom belt, means for further compressing the substrate to remove excess displacement fluid, and means for removing the dewatered substrate from the apparatus. In a preferred embodiment, the means for contacting the substrate with the displacement fluid is comprised of a pair of circular flanges mounted on each end of the roller means and a perforated displacement fluid feed pipe mounted on the frame and positioned above the belts so that displacement fluid flowing through the perforated pipe flows out of the perforations and collects on the top belt between the roller means and the flanges which form a liquid seal. In another preferred embodiment, the apparatus includes means mounted on the frame for collecting both the relatively pure water stream and the excess displacement fluid stream.

DETAILED DESCRIPTION OF THE INVENTION

The present invention relates to an energy and cost efficient apparatus of removing water from aggregate solid substrates, especially peat, coal, and biomass materials. These solids commonly have a high moisture content which must be reduced before they can be effeciently used as a fuel source, a chemical source, or disposed of, as the case may be. The apparatus is also useful for removing other liquids from aggregate solid substrates.

In the apparatus of this invention, the solid is first contacted with a nonaqueous displacement fluid which removes at least a large portion, if not all, of the water contained in the substrate. Experimentation has revealed to us that by keeping both nonaqueous displacement fluid and solid in plug flow a separation of the water and solid can be achieved wherein a major portion of the water is unmixed with the displacement fluid despite the fact that the water and fluid are necessarily (for success of the method) miscible. Our concurrently filed commonly assigned copending application entitled "Method for Dewatering Organic Solid Substrates by Miscible Liquid Displacement" filed April 11, 1983, describes and claims a method for dewatering organic solid substrates. The machine of the present invention can be used to carry out that method.

By plug flow we mean that elements of a moving phase move at the same velocity through a particular space and, therefore, elements of different residence time in a contact zone are not mixed. The simplest way to obtain dual plug flow contact between two phases is to keep one phase stationary and drive the other through it at sufficient velocity that momentum in the flow direction greatly exceeds the turbulence generating forces that would tend to promote mixing of fluid elements at different distances in the flow direction, so-called axial mixing for cylindrical geometry. When the stationary phase is solid and the fluid phase is of low viscosity, such as in chromatographic columns commonly used for chemical analyses, the condition can be achieved most easily since the solid will not be moved or dispersed at flow velocities sufficiently great so as to preclude significant axial mixing.

Our experiments have shown that for certain substrates, such as peat, water can be removed by chromatographic-type displacement using a relatively low flow rate of watermiscible solvents. A large amount of water can be removed by fluid drainage through vertical, cylindrical columns packed with the substrate, which is stationary. A continuous process, which is desirable for commercial dewatering, would move both substrate and solvent moving in plug flow through a contacting zone thereby producing the essential conditions for dewatering by this method.

Figure 1:
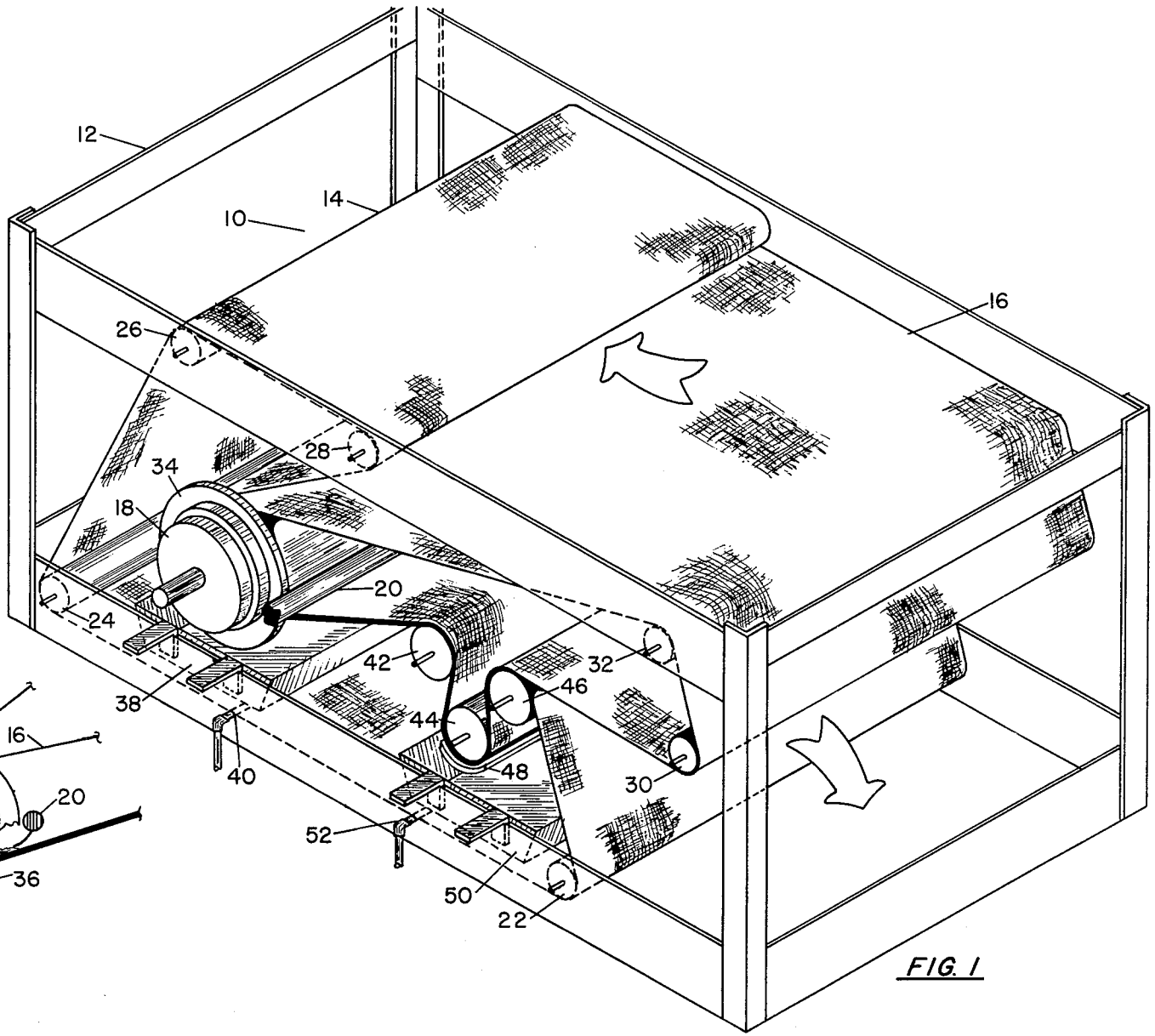
FIG. 1 is a perspective view illustrating the apparatus of the present invention.

FIG. 1 shows that the dewatering apparatus 10 is comprised of a frame 12, permeable belts 14 and 16, flanged roller 18, and perforated displacement fluid feed or delivery pipe 20. Flanged roller 18 and perforated pipe 20 are mounted on the frame 12.

Belt 14 is guided around guide rollers 22, 24, 26 and 28 so that it moves to flanged roller 18. Belt 16 is guided around guide rollers 30 and 32 before it also moves to flanged roller 18 which is rotating in the counterclockwise direction. The small arrows indicate the direction of motion of the belts 14 and 16.

Figure 2:
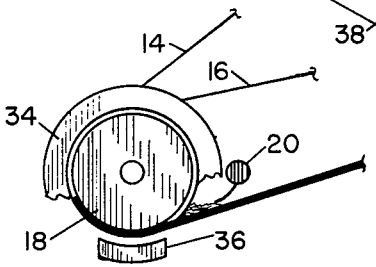
FIG. 2 is a partial view of the apparatus illustrating the means for contacting the substrate with the displacement fluid wherein the fluid collects between the roller means and the permeable belts before permeating therethrough to contact the substrate.

The substrate is deposited on the upper surface of belt 16 and thus guided, as shown by the large arrow, between the belts 14 and 16. The substrate is compressed as the belts 14 and 16 are guided around the flanged roller 18. Referring to FIG. 2, it can be seen that as the belts 14 and 16 are guided around the flanged roller 18, displacement fluid from the feed pipe 20 collects on top of the belts between the flanged roller 18 and the flanges 34. A liquid seal is formed by belt 14, roller 18, and the flanges 34. The displacement fluid will permeate through the belt inner 16 and then through the substrate. The speed of the belts 14 and 16 is adjusted so that the water is displaced through the outer belt 14 while it is located over the collecting tub 38. Water is expressed partly by the action of the compression of the belts 14 and 16 but mainly by displacement of the infiltrating, miscible displacement fluid. The water then falls into collection tub 38 which is mounted on frame 12. The water can be removed from the tub 38 through drain 40. Vacuum box 36 (see FIG. 2), the use of which is optional, increases the driving force of the fluids through the belts 14 and 16 and the substrate. When a vacuum box is used, the water flows into the box and then to a vacuum pump suitably plumbed to discharge the water as desired. The water collected in the tub 38 or vacuum box 36 is relatively pure as long as plug flow contact is maintained between the displacement fluid and the substrate and the belt speed is sufficiently fast so that the substrate is moved on to the following series of rollers before the displacement fluid reaches the outer belt 14.

The belts 14 and 16 containing the compressed substrate therebetween are then guided around compression rollers 42, 44 and 46 which are also mounted on the frame 12. The action of the compression rollers 42, 44 and 46 is such that excess displacement fluid is compressed out of the substrate through the belt 14 and into the vacuum box 48, or in the absence of a vacuum box, falls into the displacement fluid collection tub 50 which is mounted on the frame 12 and has a drain 52 for removal of the displacement fluid therefrom.

After they pass around the compression rollers 42, 44 and 46, the belts 14 and 16 separate. The substrate is removed from the apparatus 10 as shown by the large arrow. A substantial amount of the water originally contained in the substrate has been removed and it contains only a relatively small amount of the displacement fluid which can be removed by any convenient method such as evaporation or pressing.

The displacement fluid may be any liquid compound, preferably an organic compound, which is miscible with water, and will not dissolve the solid substrate from which the water is being removed. The following compounds are suitable for extracting water from solid substrates including peat and sewage sludge. The list is representative and many compounds by way of substituent additives or isomeric variation are also suitable. Expensive, corrosive, or foul-smelling compounds have not been included even though some of them might be usable with appropriately modified extractor designs.

Alcohols are especially suitable for use as the primary solvent in the present invention. Monohydroxy, $C_1$ to $C_{20}$, dihydroxy $C_2$ to $C_5$ including glycols such as ethyl glycol and propylene gylcol, and trihydroxy $C_3$ to $C_5$ are all suitable compounds. Generally, as the chain length is increased, more hydroxy or other polar substituent groups are required to achieve miscibility with water. Ketones are also suitable for use as the displacement fluid. Various $C_2$ to $C_4$ ketones such as acetone, diacetone, alcohol, and 3-hydroxy-2-butanone are examples of such compounds. Aldehydes can also be used. $C_2$ to $C_4$ aldehydes such as 3-hydroxybutanol and 1-amino-butanol are suitable. Straight chain and ring compound ethers are suitable as the primary solvent also. $C_4$ to $C_8$ ethers such as dioxane, dioxolane, morpholine, diethylene monobutyl ether, 1-hydroxylacetone, dimethyloxazole, butyrolacetone, valerolacetone, and pentenoic acid 4-hydroxylacetone are suitable examples. Caryboxylic acids, especially $C_1$ and $C_7$ acids such as formic and acetoacetic acids can be used. Straight, ring and multiple ring amine compounds can be used-because of the polar nature of nitrogen. The preferred amines are $C_2$ to $C_5$ such as benzylamine N-acetylethanolamine, t-butyl amine, diethylenetriamine, allylmethylamine, ketine, 3-methylpyrazole, diazine and pyrrolidine. There are a large number of amides which can be used because the polar nature of the nitrogen and oxygen atoms permit compounds with a larger molecular size to maintain water miscibility. Amides containing 1 to 8 carbon atoms are particularly suitable, for example, 2, 4-dinitroacetanilide and N, N-dimethylpentenoic acid amide. A wide variety of carboxylic acid esters can also be used. They follow the same pattern as that of the amides. Examples of such compounds are ethylglycinate, tetrahydrofurfuryl acetic acid ester and carbitol acetate. In addition to the above, there are a small number of compounds which are not represented by a substantial class. Examples are acetonitrile, various imines, azirane and azetidine. It should be noted that the preferred solvents for use in the present invention are methanol, ethanol and propanol because of their low cost and availability.

For best results in the contacting of the solid substrate with the displacement fluid, the mass ratio of the displacement fluid to water should be 1:1.5 to 3:1. If the ratio is less than 1:1.5, then insufficient water will be removed for most conversion processing and a ratio of more than 3:1 is not necessary because an excessive amount of mixture separation and displacement fluid recirculation will be necessary.

The rate of fluid displacement and the dewatering rate are controlled by only four general factors:

(1) the resistance to fluid flow of the mass through which the fluid travels (the substrate and the permeable belts), (2) the pressure difference across the belts, (3) the cross-sectional area through which fluid flow occurs, and (4) the viscosity of the fluid.

Once the apparatus has been constructed and the solid substrate and displacement fluid chosen, all of these factors are constant. The means through which plug flow contact between the substrate and the displacement fluid is maintained is maintaining sufficient displacement fluid pressure and flow resistance of the mass through which the fluid moves.

Consequently, the appropriate speed of operation consistent with plug flow is strongly dependent upon the permeability of the solid substrate in its compressed state and also upon the permeability of the permeable belts. Thus, the ideal or appropriate speed of operation is best determined for a particular substrate (or even for individual lots of the same substrate because the permeability will very likely vary substantially) by running a trial of the method on the disclosed apparatus or some other apparatus utilizing the method. If the speed of operation is too fast, it will be obvious because the water will be expressed downstream of the collecting tub 38 and the fluid collected in tub 50 will contain water in excess of the low concentration desired. If the speed of operation is too slow, then the purity of the water will drop significantly because of displacement fluid penetration through the outer belt 14 before passing roller 42.

The permeable belts can be made of any of the materials typically used on fourdrinier paper machines, such as polyester, nylon, brass, or steel, just to name a few. The weave and material of construction are selected based on substrate and displacement fluid compatability. The weave should be one that does not become mechanically attached to the substrate during the initial compaction between belts 14 and 16. Consequently, designs (weaves) that minimize flexing of the wires of which the belts are comprised and whose openings are not of a size and shape close to that of the substrate's component particles are preferred. For example, peat, which has a high fibrous particle content, would be dewatered most effectively using belts that do not have narrow openings whereas coal slimes or slurries containing mostly bodies of a roughly spherical shape would have less likelihood of adhering to a slotted belt than one with openings congruent with typical constituent particles. Belt blocking is not only a problem from the standpoint of separating the dewatered substrate from the belts but could also impair uniform flow of the fluids in the vicinity of the blockage during the dewatering and displacement fluid drainage steps.

If a metal belt material is chosen, it should not be sensitive to corrosion by either the displaced water (which might, for instance, in the case of peat, contain dissolved humic acids) or the displacement fluid. Polymeric belt materials should be selected on the basis of ability to withstand to compressive stresses which will be needed to obtain compaction of the substrate as well as absence of susceptibility to crazing or swelling as a result of contact with the fluids involved. Generally, the susceptibility can best be established using standard immersion tests.

Sources of information on the permeability of the belts are the belt manufacturers and published reviews such as "Fluid Flow Through Woven Screens" by J. Armour, et al, *AICHE Journal Vol.* 14, *No.* 3, p. 415–20 and "Hydraulic Behavior of Synthetic Non-Woven Filter Fabrics" by A. L. Rollin, et al., *Canadian Journal of Chemical Engineering, Vol.* 60, p. 226–34.

The permeability of these belts should be in the range of 20 to 200 darcies (1 cubic centimeter per second flow of the fluid with a 1 centipoise viscosity through 1 centimeter of material with a 1 square centimeter cross-sectional area under a 1 atmosphere pressure differential). Laboratory methods of measuring the permeability of the compacted substrate could consist of filling class columns with substrate, compacting it mechanically and draining displacement fluid through the column with or without air pressure above the fluid head, as discussed in our copending patent application *Organic Solid Sub-*

*strate Dewatering Process Based on Plug Flow Contact by an Extractive Fluid,* Ser. No. 327,610.

Interpretation of such results, for the purpose of application to a machine of this invention, can be complicated since unavoidably the density and hence the permeability of compacted columns vary along the column. As an example, columns of shredded peat indicate a variation:

$$\Delta v/V_O \doteq \tfrac{8}{3}e-0.2x$$

where x is the distance in centimeters from the pressed surface, and

ΔV is the change in volume of a layer of initial volume V.

We recommend that columns of several thicknesses be tested and the determined permeability from these tests be used to extropolate a value for the substrate thickness for continuous dewatering as herein discussed. This is necessary because usually a substrate thickness as low as appropriate for continuous dewatering cannot be conveniently tested in a column because of its low permeability. For accurate measurements the ideal method is to use a laboratory scale version of the machine discussed here and in the copending application.

The dewatering rate of the apparatus can be increased by varying two parameters. First, the contact zone cross-sectional area can be increased by increasing the width of the machine. Second, the displacement fluid pressure can be increased. It is proportional to the height of the displacement fluid pool above the belts which will normally be as large as the flanges and the diameter of the flanged roller will allow. Ultimately, the pool height will be limited by the size of the flanged roller which would be excessively expensive if greater than a few feet.

An alternate means of increasing the effective displacement pressure is to mount vacuum boxes below the first drum which seal against the bottom surface of the outer belt. By such means, production rates as much as 200 times that described in the following example can be obtained. For even greater production rates without enlarging the machine's dimensions, pneumatic pressure could be applied above the displacement fluid pool. This would be a relatively expensive modification since the pool would have to be enclosed in a presure-tight vessel which was sealed against the belt edges.

EXAMPLE

The apparatus of the present invention is used to dewater compacted peat with a permeability of 25 darcies. This level of permeability provides sufficient flow resistance to produce the desired plug-like uniform displacement of water by the displacement fluid, which in this example is methanol. 2.6 pounds per minute of granular, 75% moisture—95% by volume air and/or moisture peat is fed into the apparatus so as to be disposed in a uniform ¼ inch thick layer between the moving belts. The peat has a density of about 0.80 grams per cubic centimeter. A displacement fluid height equivalent to 1 inch of water is used in the displacement fluid collection area to drive the displacement of the water by the methanol. The belt speed is 5 inches per minute. Water containing 5% displacement fluid is collected and the water content of the peat is reduced to 10% moisture.

We claim:

1. An apparatus for dewatering an aggregate solid substrate which comprises:

(a) a frame, (b) two movable, permeable belts, (c) means mounted on said frame for guiding and moving said belts, (d) roller means mounted on said frame for positioning said belts such that said substrate is guided and compressed between them, (e) means for contacting said substrate with a displacement fluid while it is compressed between said belts such that said fluid collects between the top belt and said roller means before permeating through the top belt and contacting said substrate, (f) means for removing relatively pure water which is expressed by said fluid through the bottom belt, (g) means for further compressing said substrate to remove excess displacement fluid, and (h) means for removing the dewatered substrate from the apparatus.

2. The apparatus of claim 1 which further comprises means for collecting relatively pure water and means for collecting excess displacement fluid.

3. The apparatus of claim 2 wherein the means of (e) comprises a perforated displacement fluid feed pipe mounted on the frame and disposed above the belts and the roller means and further comprises circular flanges mounted on the ends of the roller means which form a liquid seal with the top belt and the roller means.

4. The apparatus of claim 2 wherein the means of (f) is a vacuum box to increase the flow of water and displacement fluid through the belts and substrate.

* * * * *